US010252131B2

(12) United States Patent
May, II et al.

(10) Patent No.: US 10,252,131 B2
(45) Date of Patent: Apr. 9, 2019

(54) SPORTS TRAINING DEVICE

(71) Applicants: Roger Delano May, II, Goldsboro, NC (US); Bobby John Lamm, Wilson, NC (US)

(72) Inventors: Roger Delano May, II, Goldsboro, NC (US); Bobby John Lamm, Wilson, NC (US)

( * ) Notice: Subject to any disclaimer, the term of this patent is extended or adjusted under 35 U.S.C. 154(b) by 355 days.

(21) Appl. No.: 14/159,524

(22) Filed: Jan. 21, 2014

(65) Prior Publication Data

US 2015/0202513 A1 Jul. 23, 2015

(51) Int. Cl.

| | |
|---|---|
| ***A63B 69/00*** | (2006.01) |
| *A63B 102/32* | (2015.01) |
| *A63B 102/18* | (2015.01) |

(52) U.S. Cl.

CPC .. *A63B 69/0057* (2013.01); *A63B 2069/0008* (2013.01); *A63B 2102/18* (2015.10); *A63B 2102/182* (2015.10); *A63B 2102/32* (2015.10); *A63B 2208/0204* (2013.01); *A63B 2210/50* (2013.01); *A63B 2225/09* (2013.01); *A63B 2225/093* (2013.01)

(58) Field of Classification Search

CPC ..... A63B 2225/093; A63B 2225/09; A63B 69/0057; A63B 69/3667; A63B 69/3608; A63B 69/3641; A63B 69/0008

USPC ..... 473/451, 452, 265–277

See application file for complete search history.

(56) References Cited

U.S. PATENT DOCUMENTS

| | | | | | |
|---|---|---|---|---|---|
| 3,215,438 | A * | 11/1965 | Sheldon | A63B 69/3608 | 473/277 |
| 3,623,733 | A * | 11/1971 | Cavanaugh | 473/265 | |
| 4,998,731 | A * | 3/1991 | Bowen | 473/271 | |
| 5,083,789 | A * | 1/1992 | Hickson | A63B 69/3667 | 473/272 |
| 5,288,074 | A * | 2/1994 | Scheurer | 473/277 | |
| 5,328,186 | A * | 7/1994 | Hanson | A63B 69/3667 | 473/218 |
| 5,707,300 | A * | 1/1998 | May et al. | 473/257 | |
| 5,769,732 | A * | 6/1998 | O'Neal | 473/258 | |
| 5,830,079 | A * | 11/1998 | Hudson | 473/272 | |
| 6,343,998 | B1 * | 2/2002 | Tarulli et al. | 473/273 | |
| 6,497,627 | B2 * | 12/2002 | Collins | 473/264 | |
| 6,575,844 | B1 * | 6/2003 | Gray | 473/277 | |
| 6,843,730 | B1 * | 1/2005 | Bellagamba | 473/216 | |
| 7,204,766 | B1 * | 4/2007 | Rose | A63B 69/0059 | 473/266 |
| 7,591,734 | B2 * | 9/2009 | Mazzone | 473/277 | |
| 8,088,020 | B2 * | 1/2012 | Groves | A63B 69/0057 | 473/266 |
| 8,696,480 | B2 * | 4/2014 | Sasser | 473/208 | |

(Continued)

*Primary Examiner* — Mark S Graham

(74) *Attorney, Agent, or Firm* — Blynn L. Shideler; Krisanne Shideler; BLK Law Group

(57) ABSTRACT

A sports training aid is provided that includes a base, a support structure and a top portion. The base structure may support the support structure and the top portion in an upright position when placed on a surface. The top portion includes a first side and a second side with extensions extending towards a user. A waist boundary is formed in between the extensions. Therefore, a user may position their waist within the extensions and practice a swing. The extensions of the sports training device may provide proper restriction and thereby train a user to have a proper hip rotation.

20 Claims, 4 Drawing Sheets

(56) References Cited

U.S. PATENT DOCUMENTS

| | | | | |
|---|---|---|---|---|
| 8,784,229 | B1 * | 7/2014 | McCullough | 473/257 |
| 2005/0159234 | A1 * | 7/2005 | Lee et al. | 473/277 |
| 2006/0121999 | A1 * | 6/2006 | Bender | 473/207 |
| 2007/0243955 | A1 * | 10/2007 | Du Brock | 473/452 |
| 2011/0275447 | A1 * | 11/2011 | Jasinski | 473/271 |
| 2012/0264533 | A1 * | 10/2012 | Sasser A63B | 69/3641 473/208 |

* cited by examiner

SPORTS TRAINING DEVICE

BACKGROUND OF THE INVENTION

The present invention relates to a sports training device and, more particularly, to a sports training device that focuses on proper balance and hip rotation.

Hitters taking part in baseball, softball, and golf may have improper weight transfer through the mechanics of the swing. Current training aids focus only on the swing and do not focus on the proper balance and hip rotation.

As can be seen, there is a need for a training device that focuses on proper balance and hip rotation.

SUMMARY OF THE INVENTION

In one aspect of the present invention, a sports training device comprises: a base configured to rest on a surface; a support structure extending from the base in a substantially vertical position relative to the surface in which the base is configured to rest on; and a top portion attached to the support structure, wherein the top portion comprises a top first side and a top second side, wherein the top first side and the top second side are substantially parallel with the surface, wherein the top first side comprises a first top extension extending laterally from the top first side and is substantially perpendicular relative to the top first side, and the top second side comprises a top second extension extending laterally from the top second side in substantially the same direction as the first top extension, wherein a hip boundary is formed in between the first top extension and the second extension, wherein at least one of the top first side and the top second side comprises an adjustable length.

These and other features, aspects and advantages of the present invention will become better understood with reference to the following drawings, description and claims.

DETAILED DESCRIPTION OF THE INVENTION

Figure 1:
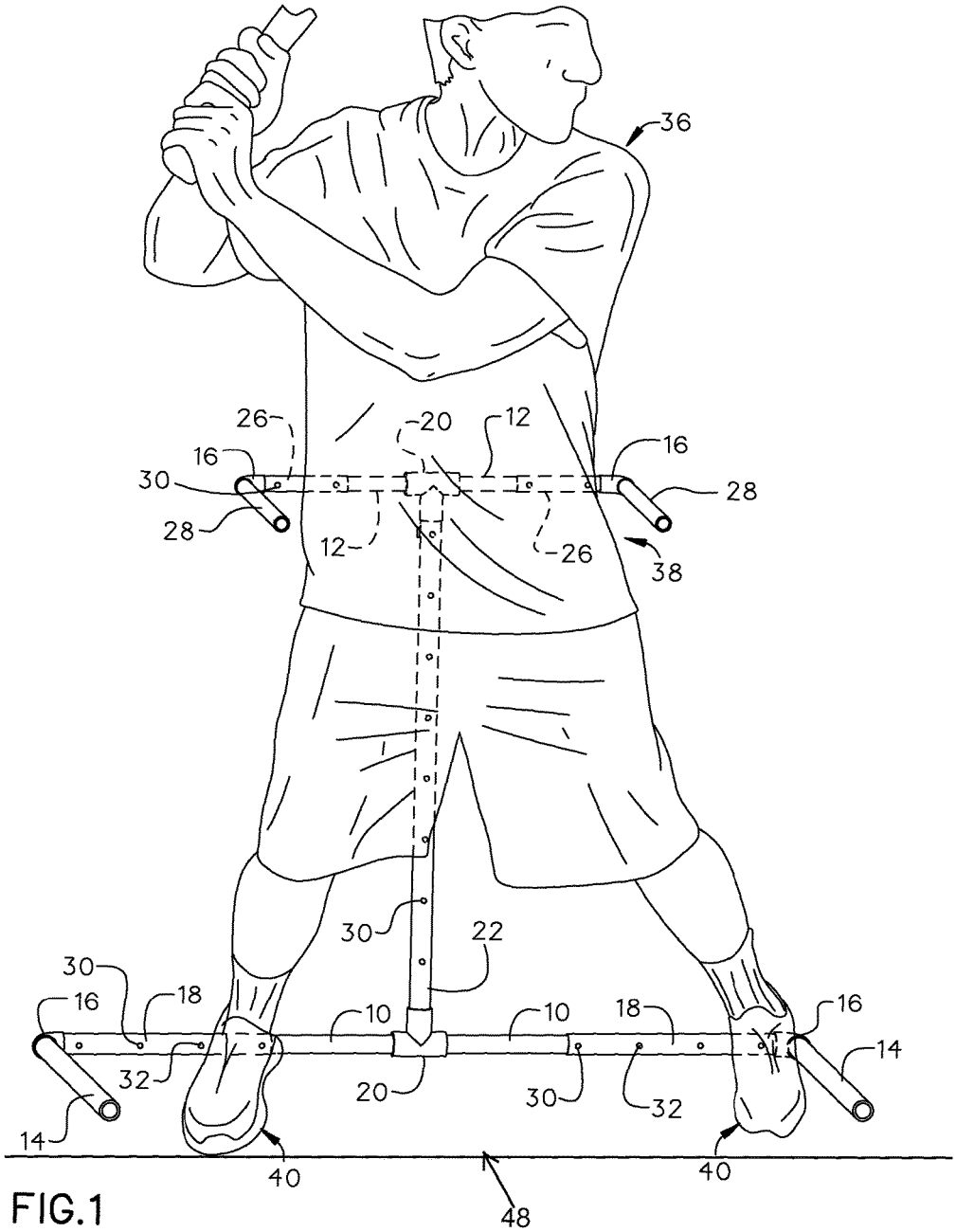
FIG. 1 is a perspective view of the present invention shown in use.
Figures 2, 3, 4, 5:
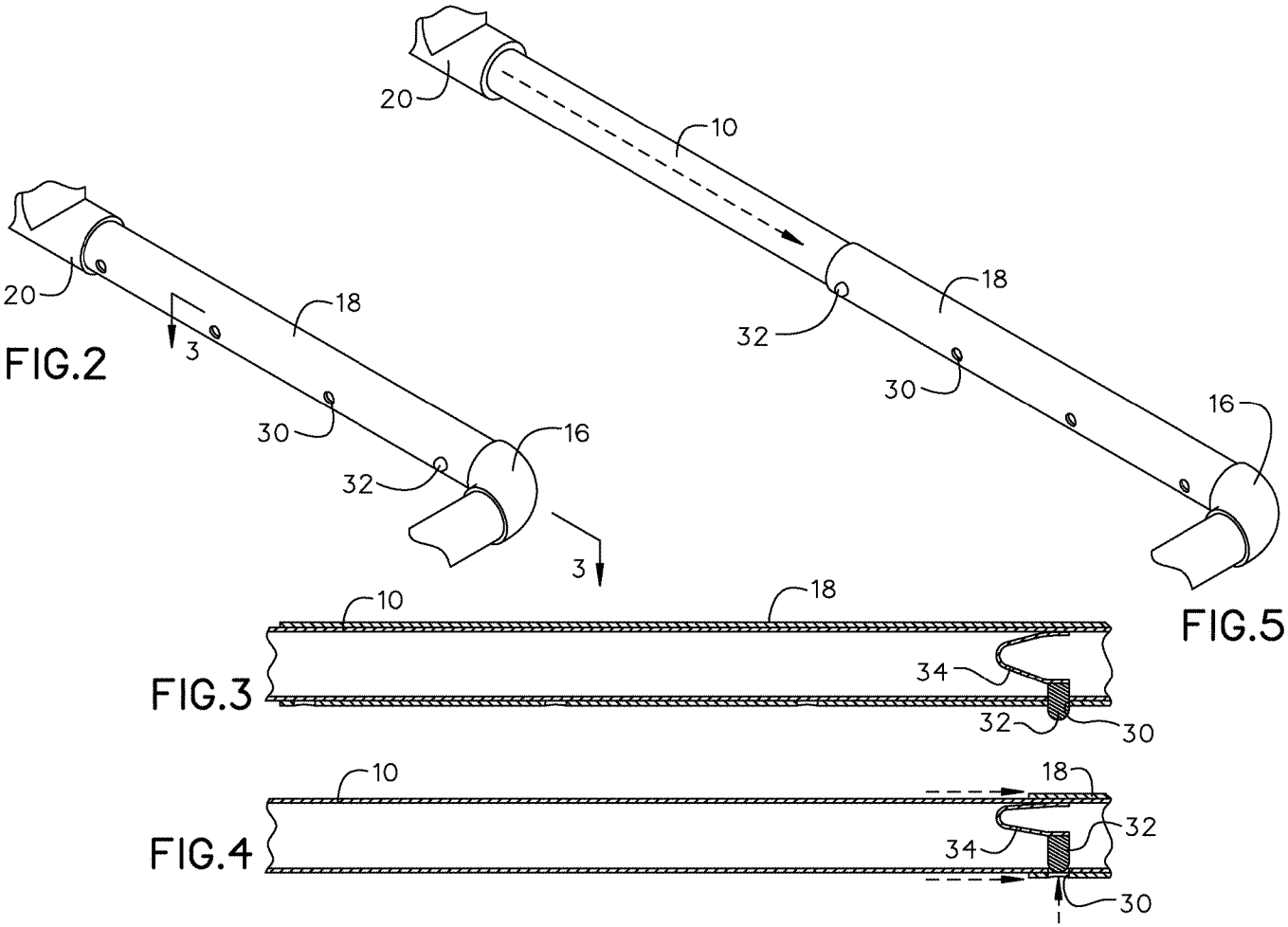
FIG. 2 is a perspective detail view of the present invention demonstrated in retracted configuration.
FIG. 3 is a section detail view of the present invention along line 3-3 in FIG. 2.
FIG. 4 is a section detail view of the present invention demonstrated in an unlocked and extended configuration.
FIG. 5 is a perspective detail view of the present invention demonstrated in an extended configuration.
Figure 6:
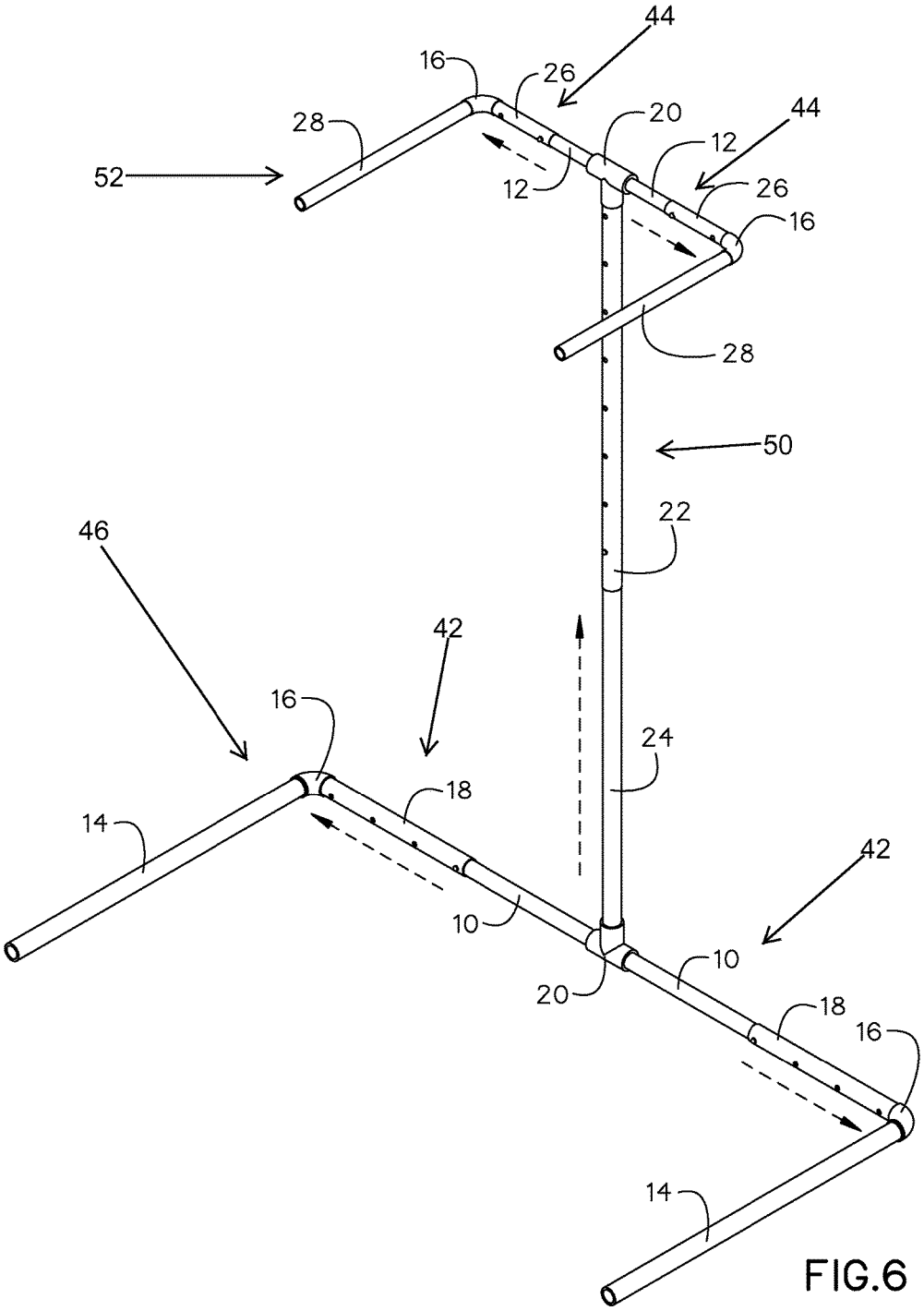
FIG. 6 is a perspective view of the present invention demonstrating various telescoping actions.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a sports training aid that includes a base, a support structure and a top portion. The base structure may support the support structure and the top portion in an upright position when placed on a surface. The top portion includes a first side and a second side with extensions extending towards a user. A waist boundary is formed in between the extensions. Therefore, a user may position their waist within the extensions and practice a swing. The extensions of the sports training device may provide proper restriction and thereby train a user to have a proper hip rotation.

The present invention includes a training aid for golf, baseball, and softball. The present invention may develop proper muscle memory in the weight transfer of one's swing. By using the present invention through repetition, the athlete may develop the correct weight transfer in the swing. The present invention may isolate the proper mechanics of the hip rotation, thus improving balance throughout the swing.

Referring to FIGS. 1 through 7, the present invention may include a sports training device having base 46, a support structure 50 having a bottom connected to the base 46, and a top portion 52 connected to the top of support structure 50. The base 46 may be configured to rest on a surface 48 and support the training device in an upward position. The support structure 50 may extend from the base 46 in a substantially vertical position relative to the surface in which the base 46 is resting on.

In certain embodiments, the top portion 42 may include a top first side 44 and a top second side 44. The top first side 44 and the top second side 44 may be substantially parallel with the surface 48. The top first side 44 may include a first top extension 28 extending laterally from the top first side 44. The first top extension 28 may be substantially perpendicular relative to the top first side 44. The top second side 44 may include a top second extension 28 extending laterally from the top second side 44 in substantially the same direction as the first top extension 28. A waist boundary is formed in between the first top extension 28 and the second top extension 28. Therefore, when a user 36 places their waist 38 within the waist boundary, the user 36 may practice swinging without a proper hip rotation.

In certain embodiments, the base 46 may include a base first side 42 and a base second side 42 substantially parallel and aligning with the top first side 44 and the top second side 44. The base first side 42 may include a first base extension 14 extending laterally from the base first side 42 and is substantially perpendicular relative to the base first side 42. The base second side 42 may include a second base extension 14 extending laterally from the base second side 42 in substantially the same direction as the first base extension, 42. A feet boundary is formed in between the first base extension 42 and the second base extension 42. Therefore, a user 36 practicing with the sports training device of the present invention may place their feet within the feet boundary during practice.

In certain embodiments, at least one of the top first side 44 and the top second side 44 may be adjustable in length to accommodate different user 36 sizes. For example, both of the top sides 44 may be adjustable in length. In certain embodiments, at least one of the base first side 42 and the base second side 42 may be adjustable in length to accommodate different user 36 sizes and appropriate stances. For example, both of the base sides 42 may be adjustable in length. In certain embodiments, the support structure 50 is adjustable in height to accommodate the different heights of the users 36. In certain embodiments, the base 46 may be adjusted to a greater length than the top portion 52. Such embodiments accommodates for a stance that is wider than the user's waist 38.

The adjustability of the present invention may be utilized using telescoping pipes. However, it is envisioned that any way of adjusting the present invention may be utilized.

In certain embodiments, the top first side 44 and the top second side 44 may each include an arm inner pipe 12 and an arm outer pipe 26 that fits around and encloses at least a portion of the arm inner pipe 12. The arm outer pipes 26 may include a plurality of spring clip holes 30 and each of the arm inner pipes 12 may include a spring pin 32, 34 having a pin portion 32 and a spring portion 34. The pin portion 32 may fit into a selected spring clip hole 30 to retain the top first side 44 and the top second side 44 at a desired length.

In certain embodiments the base first side 42 and the base second side 42 each comprise a leg inner pipe 10 and a leg outer pipe 18 that fits around and encloses at least a portion of the leg inner pipe 10. Each of the leg outer pipes 18 may include a plurality of spring clip holes 30 and each of the leg inner pipes 10 may include a spring clip pin 32, 34 fitting into a selected spring clip hole 30 to retain the base first side 42 and the base second side 42 at a desired length.

In certain embodiments, the support structure 50 may include an inner center pole 24 and an outer center pole 22 that fits around and encloses at least a portion of the inner center pole 24. The outer center pole 22 may include a plurality of spring clip holes 30 and the inner center pole 24 may include a spring clip pin 32, 34 fitting into a selected spring clip hole 30 to retain the support structure 50 at a desired height.

Figure 7:
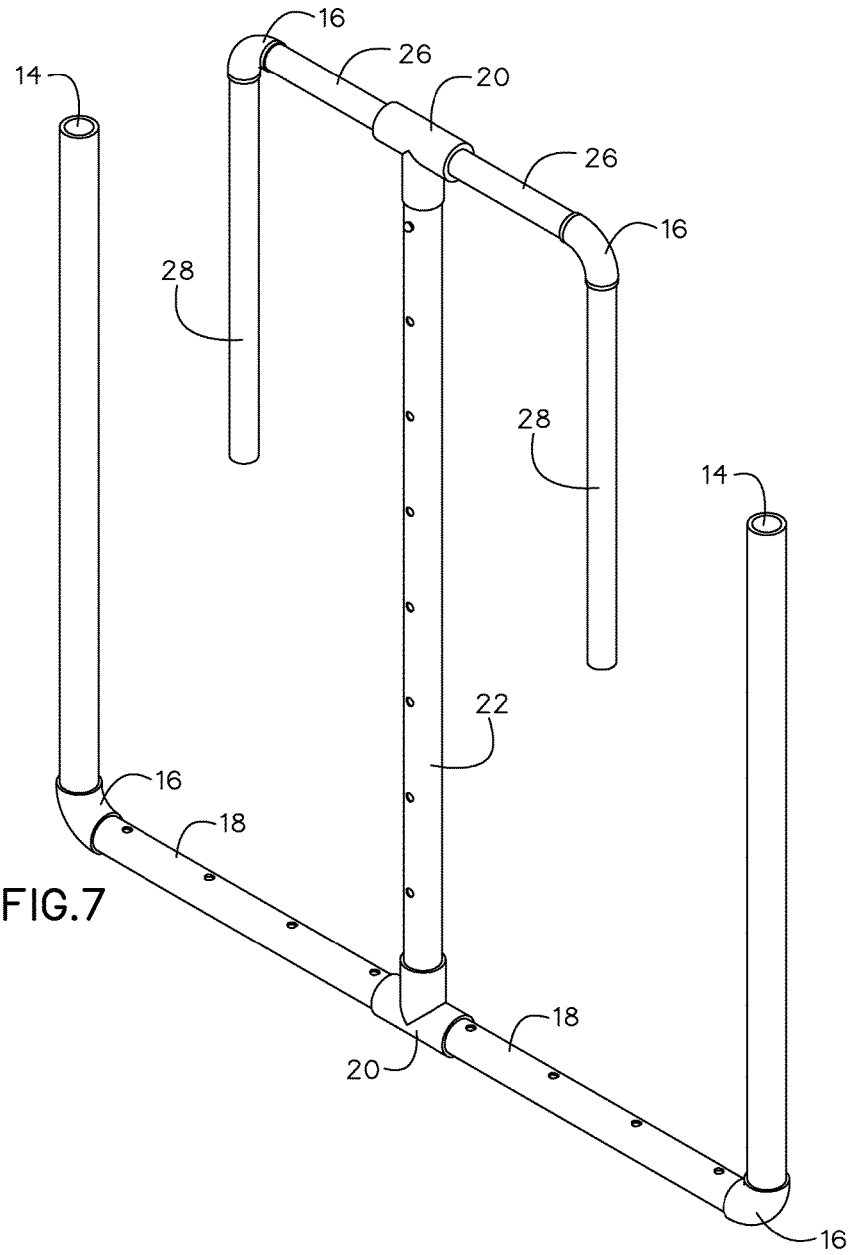
FIG. 7 is a perspective view of the present invention demonstrating a storage/transportation configuration.

The present invention may be made of PVC piping or any appropriate piping. As illustrated in the Figures, the base sides 42 may be connected together by a T-fitting 20. The support structure 50 may connect to the base 46 by the T-fitting 20. The base extensions 14 may attach to the base sides 42 by an elbow fitting 16. Similarly, the top sides 44 may be connected together by a second T-fitting 20. The support structure 50 may connect to the top portion 52 by the second T-fitting 20. The top extensions 28 may attach to the top sides 44 by an elbow fitting 16. In such embodiments, the present invention may be placed in a compressed form in which the base extensions 14 and the top extensions 28 are rotated to face one another, as illustrated in FIG. 7. Further, in such embodiments, the sports training device may be easily taken apart and put back together.

The present invention may include the following dimensions: the leg inner pipe 10 may have a ⅞" diameter; the arm inner pipe 12 may have a 11/16" diameter; the base extensions 14 may have a 1" diameter; the leg outer pipe 18 may have a 1" diameter; the outer center pole 22 may have a 1" diameter; the inner center pole 24 may have a 15/16" diameter; the arm outer pipe 26 may have a ¾" diameter; and the top extensions 28 may have a ¾" diameter. However, the dimensions are not limited to the above and may be any suitable dimensions that may facilitate the function of the present invention.

It should be understood, of course, that the foregoing relates to exemplary embodiments of the invention and that modifications may be made without departing from the spirit and scope of the invention as set forth in the following claims.

What is claimed is:

1. A sports training device comprising:

a base configured to rest on a surface, the base including a base first side extending in a first direction from a centerline of the sports training device with a first base extension extending laterally from a distal end of the base first side, a base second side extending in a second direction from the centerline of the sports training device with a second base extension extending laterally from a distal end of the base second side, wherein the first base extension and the second base extension are coupled together only at one end via the base first side and the base second side, wherein a feet boundary is formed in between the first base extension and the second base extension whereby a user practicing with the sports training device may place their feet within the feet boundary during practice and wherein the base first side and the base second side are configured to be behind the user in use;

a support structure extending from the base from the centerline of the sports training device and extending in a substantially vertical position relative to the surface in which the base is configured to rest on; and a top portion attached to the support structure, wherein the top portion comprises a top first side extending in the first direction from the centerline of the sports training device and a top second side extending in the second direction from the centerline of the sports training device, wherein the top first side and the top second side are substantially parallel with the surface, wherein the top first side comprises a first top extension extending laterally and cantilevered from the top first side and is substantially perpendicular relative to the top first side, and the top second side comprises a top second extension extending laterally and cantilevered from the top second side in substantially the same direction as the first top extension, wherein a waist boundary is formed in between the first top extension and the second extension, whereby a user practicing with the sports training device may place their waist within the waist boundary between extending portions of the cantilevered first top extension and the cantilevered second top extension during practice whereby a vertical plane extending through the user's waist during at least part of practice will extend simultaneously through both the cantilevered first top extension and the cantilevered second top extension.

2. The sports training device of claim 1, wherein at least one of the top first side and the top second side comprises an adjustable length.

3. The sports training device of claim 2, wherein at least one of the base first side and the base second side comprises an adjustable length.

4. The sports training device of claim 3, wherein the support structure comprises an adjustable height.

5. The sports training device of claim 4, wherein each of the top first side and the top second side comprise an adjustable length.

6. The sports training device of claim 5, wherein each of the base first side and the base second side comprise an adjustable length.

7. The sports training device of claim 6, wherein the base is capable of extending to a length greater than the top portion.

8. The sports training device of claim 7, wherein the top first side and the top second side each comprise an arm inner pipe and an arm outer pipe that fits around the arm inner pipe, wherein each of the arm outer pipes comprise a plurality of spring clip holes and each of the arm inner pipes comprise a spring clip fitting into a selected spring clip hole to retain the top first side and the top second side at a desired length.

9. The sports training device of claim 8, wherein the base first side and the base second side each comprise a leg inner pipe and a leg outer pipe that fits around the leg inner pipe, wherein each of the leg outer pipes comprise a plurality of spring clip holes and each of the leg inner pipes comprise a spring clip fitting into a selected spring clip hole to retain the base first side and the base second side at a desired length.

10. The sports training device of claim 9, wherein the support structure comprises an inner center pole and an outer center pole that fits around the inner center pole, wherein the outer center pole comprises a plurality of spring clip holes and the inner center pole comprises a spring clip fitting into a selected spring clip hole to retain the support structure at a desired height.

11. The sports training device of claim 10, wherein an angle relative to the first top extension and the surface is adjustable.

12. The sports training device of claim 11, wherein an angle relative to the second top extension and the surface is adjustable.

13. The sports training device of claim 12 wherein the top first side and the top second side are rotatable relative to the support structure to adjust the angle of the first top extension and the second top extension relative to the surface.

14. A sports training device comprising:

a base configured to rest on a surface, the base including base first side pipes configured to rest on the surface and which are adjustable in length and are extending in a first direction from a centerline of the sports training device with a first base extension member extending laterally from a distal end of the base first side pipes and configured to rest on the surface, base second side pipes which are adjustable in length configured to rest on the surface and extending in a second direction from the centerline of the sports training device with a second base extension member configured to rest on the surface and extending laterally from a distal end of the base second side pipes, wherein the first base extension member and the second base extension member are coupled together only at one end via the base first side pipes and the base second side pipes, wherein a feet boundary is formed in between the first base extension member and the second base extension member whereby a user practicing with the sports training device may place their feet within the feet boundary with the base first and second side pipes behind the user during practice and wherein the base first side pipes and the base second side pipes are configured to be behind the user in use;

a support structure extending from the base from the centerline of the sports training device and extending in a substantially vertical position relative to the surface in which the base is configured to rest on, the support structure including poles that are adjustable in length; and a top portion attached to the support structure, wherein the top portion comprises top first side pipes which are adjustable in length extending in the first direction from the centerline of the sports training device and top second side pipes which are adjustable in length extending in the second direction from the centerline of the sports training device, wherein the top first side pipes and the top second side pipes are substantially parallel with the surface, wherein the top first side pipes comprise a first top extension member extending laterally and cantilevered from the top first side pipes, and the top second side pipes comprise a top second extension member extending laterally and cantilevered from the top second side pipes in substantially the same direction as the first top extension member, wherein a waist boundary is formed in between the first top extension member and the second extension member, whereby a user practicing with the sports training device may place their waist within the waist boundary between extending portions of the cantilevered first top extension member and the cantilevered second top extension member during practice whereby a vertical plane extending through the user's waist during at least part of practice will extend simultaneously through both the cantilevered first top extension member and the cantilevered second top extension member.

15. The sports training device of claim 14, wherein the base is capable of extending to a length greater than the top portion.

16. The sports training device of claim 15, wherein the top first side pipes and the top second side pipes each comprise an arm inner pipe and an arm outer pipe that fits around the arm inner pipe, wherein each of the arm outer pipes comprise a plurality of spring clip holes and each of the arm inner pipes comprise a spring clip fitting into a selected spring clip hole to retain the top first side pipes and the top second side pipes at a desired length.

17. The sports training device of claim 16, wherein the base first side pipes and the base second side pipes each comprise a leg inner pipe and a leg outer pipe that fits around the leg inner pipe, wherein each of the leg outer pipes comprise a plurality of spring clip holes and each of the leg inner pipes comprise a spring clip fitting into a selected spring clip hole to retain the base first side pipes and the base second side pipes at a desired length.

18. The sports training device of claim 17, wherein the support structure comprises an inner center pole and an outer center pole that fits around the inner center pole, wherein the outer center pole comprises a plurality of spring clip holes and the inner center pole comprises a spring clip fitting into a selected spring clip hole to retain the support structure at a desired height.

19. The sports training device of claim 18, wherein an angle relative to the first top extension member and the surface is adjustable.

20. The sports training device of claim 19 wherein the top first side pipes are rotatable relative to the support structure to adjust the angle of the first top extension member relative to the surface.

* * * * *